US006328308B1

(12) United States Patent
Kirby

(10) Patent No.: US 6,328,308 B1
(45) **Date of Patent: *Dec. 11, 2001**

(54) CREATIVE COMPARISON CARD-GAME W/BOARD-GAME VARIANT

(76) Inventor: Matthew A. Kirby, 12503 Sundance Ave., San Diego, CA (US) 92129

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/170,151

(22) Filed: Oct. 13, 1998

(51) Int. Cl.[7] ..... G09B 19/00
(52) U.S. Cl. ..... 273/299; 273/429
(58) Field of Search ..... 273/272, 273, 273/292, 299, 429; 434/156, 159, 167

(56) References Cited

U.S. PATENT DOCUMENTS 3,235,976 * 2/1966 Elliot .
3,618,231 * 11/1971 Nason .
4,470,821 * 9/1984 LeCapelain .
5,492,473 * 2/1996 Shea .
5,772,212 * 6/1998 Hagedorn .

* cited by examiner

*Primary Examiner*—William M. Pierce

(74) *Attorney, Agent, or Firm*—Henri J. A. Charmasson; John D. Buchaca

(57) ABSTRACT

The invention involves an array of playing-cards playable by three or more persons, which delightfully spontaneous if unpredictable word, term, phrase, or picture comparison combinations, invites stimulating social-intercourse. Of the two essential sets of cards furnished with the basic OuickPik™-game iteration, an exemplified first set of Apple-cards each bear different pictures or terms generally derived from: "people, events, nature, places, things, etc."; while a set of Orange-cards each may bear a picture or descriptive wording such as the terms—"bumpy, slow, magnificent". Thus, Apple-cards are randomly issued for comparison as to which best typifies the Orange-card over the others,—hence comparing—"apples and oranges"; and a "quick-pick" feature takes the slowest player briefly out of contention,—thereby compelling an exciting rapid-pace. An enhanced 2nd/iteration referred to as MindReader™-game, employs interspersed surprise Mindreader-cards, whereby a player acting as Judge for a round of play selects several Apple-cards for a provisional Picker and Mindreader to compare to the inscription revealed upon a randomly turned-up Orange-card. If the Picker and Mindreader players of that round select the same Apple-card, they each collect bonus Orange-cards, Judge does not;—or instead, the Judge may "stump" those two players and collect the bonus Orange-cards for themself! A more elaborate 3rd/iteration, Jumbo-A&O™, includes a gameboard, and a die thrown to determine spatial advances of player pieces along a spiral pathway of special function-squares convergent toward a winner's-circle goal.

10 Claims, 5 Drawing Sheets

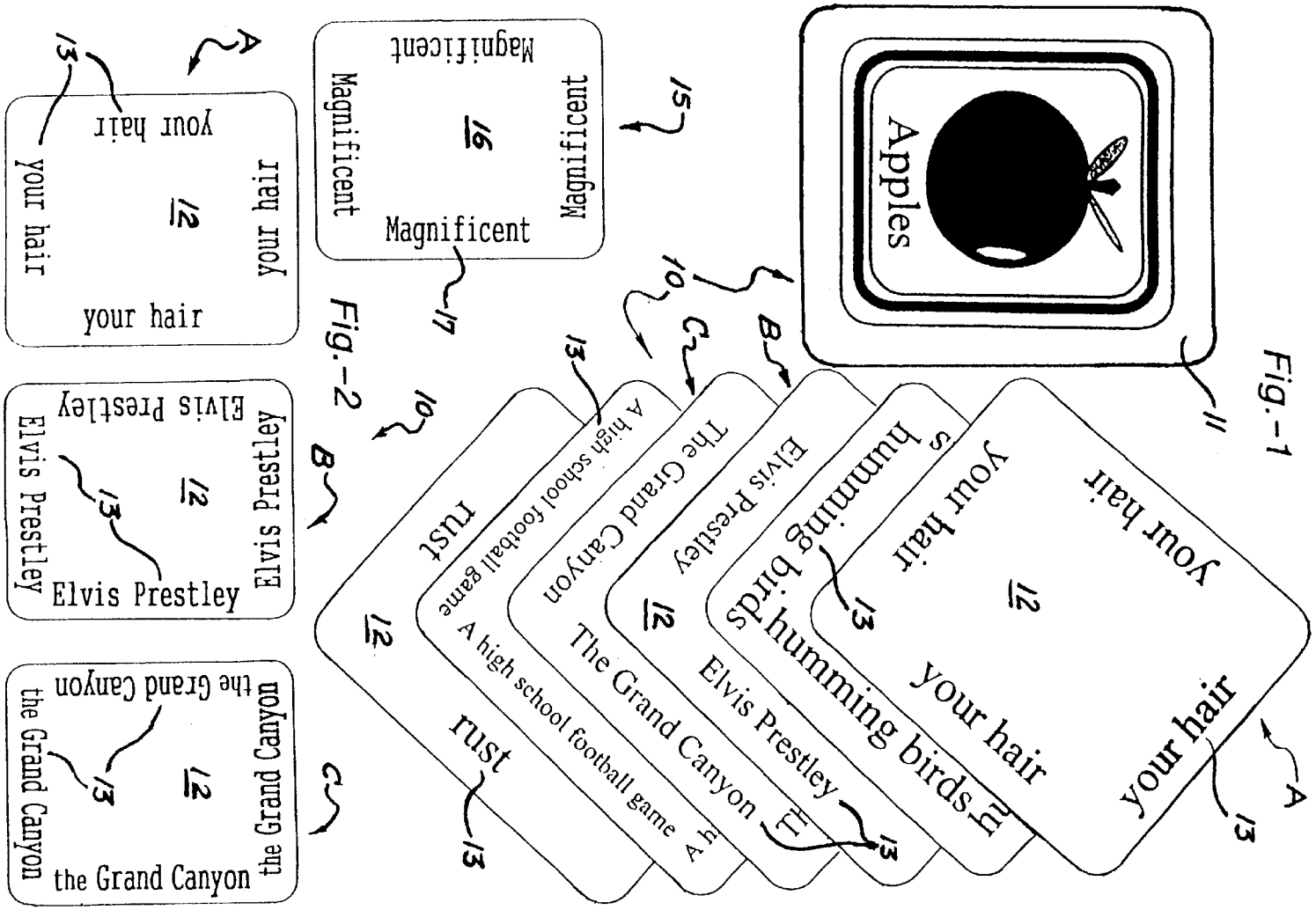
Fig.-1
Apples
your hair
your hair
your hair
your hair
humming birds
humming birds
Elvis Prestley
Elvis Prestley
The Grand Canyon
The Grand Canyon
A high school football game
A high school football game
rust
rust
Magnificent
Magnificent
Magnificent
Magnificent
Fig.-2
your hair
your hair
your hair
your hair
Elvis Prestley
Elvis Prestley
Elvis Prestley
Elvis Prestley
the Grand Canyon
the Grand Canyon
the Grand Canyon
the Grand Canyon
A
B
C
10
11
12
13
15
16
17

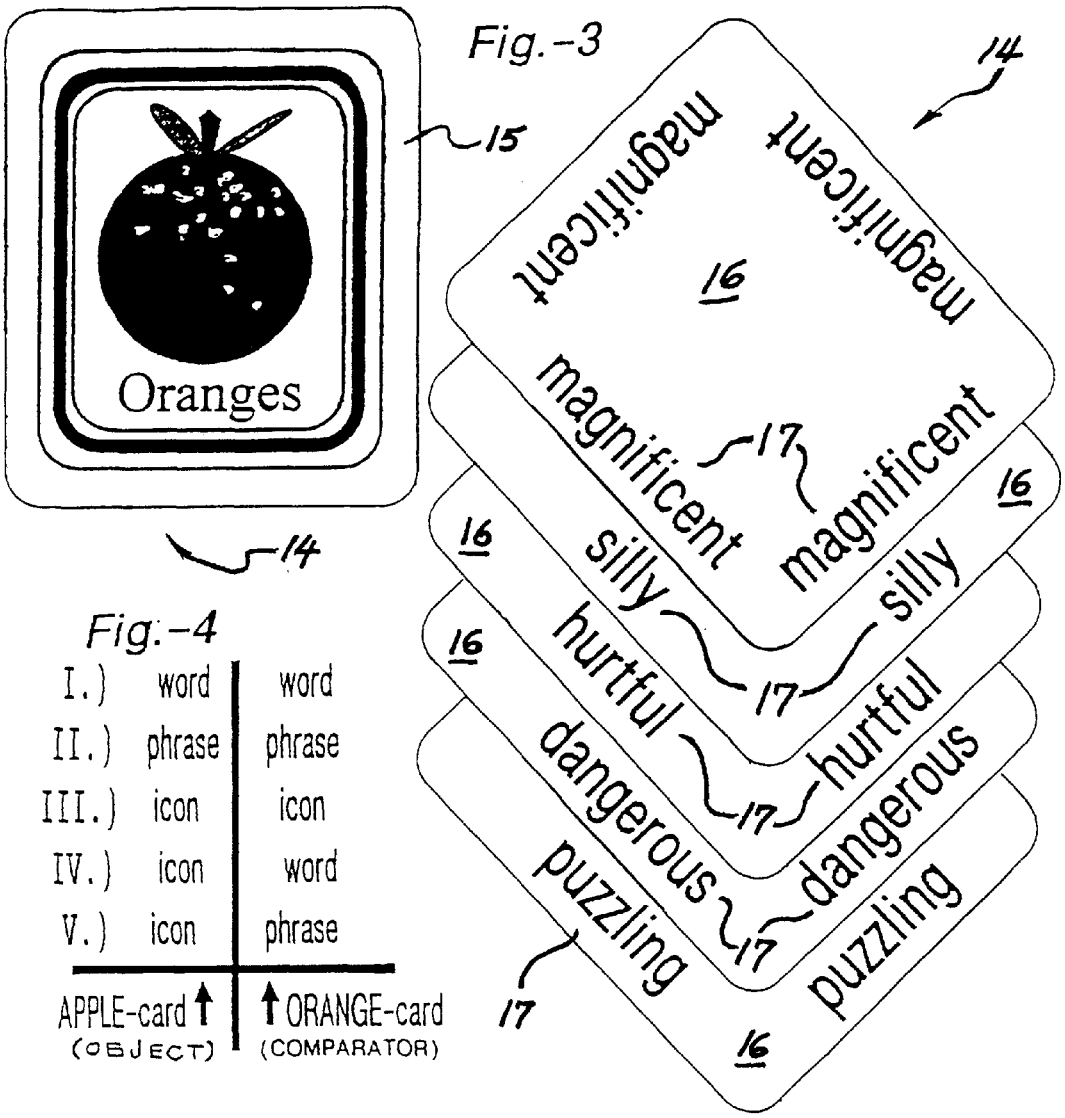
Fig.-3
Fig.-4
| | | |
|---|---|---|
| I.) | word | word |
| II.) | phrase | phrase |
| III.) | icon | icon |
| IV.) | icon | word |
| V.) | icon | phrase |
| | APPLE-card ↑ (OBJECT) | ↑ ORANGE-card (COMPARATOR) |
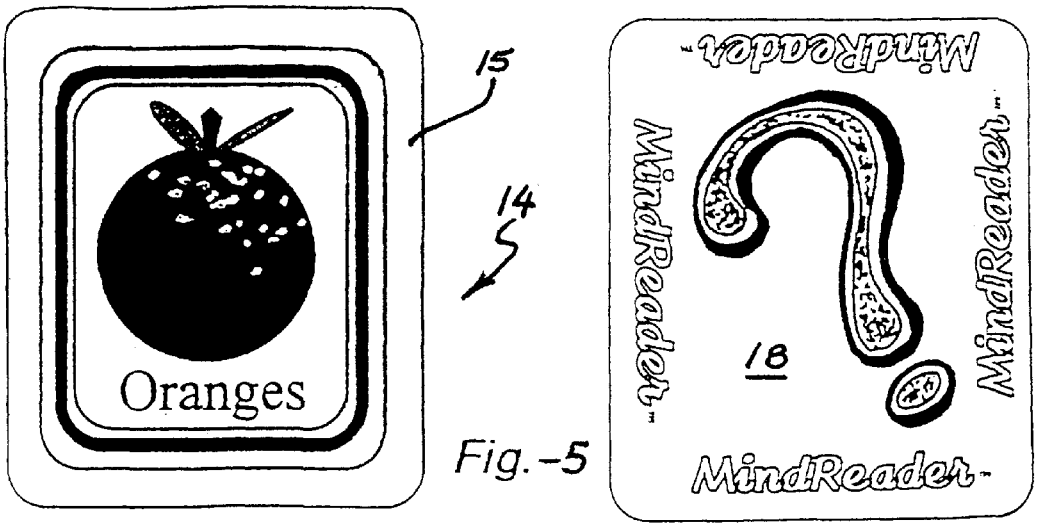
Fig.-5

Fig.-8
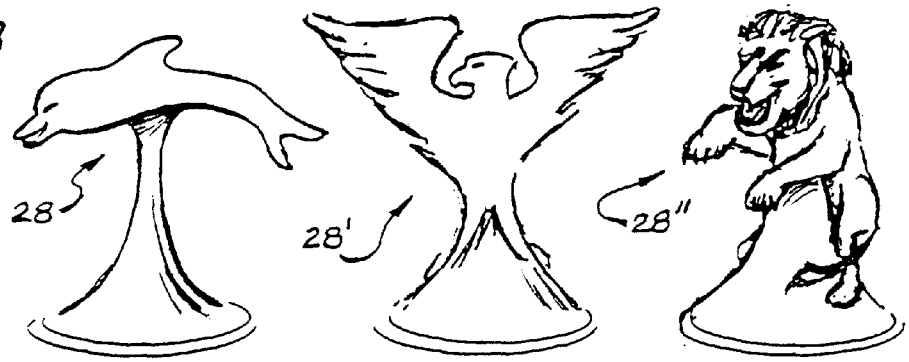
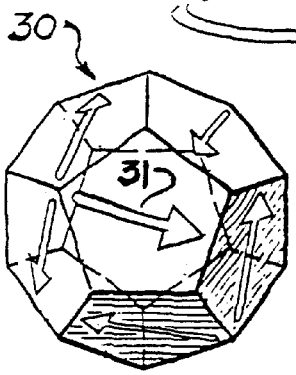
Fig.-9
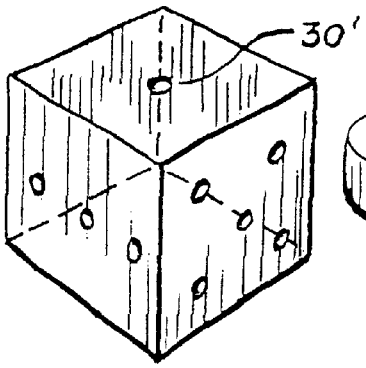
Fig.-10
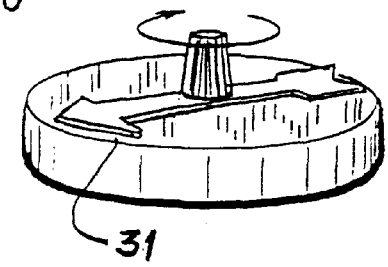
Fig.-11
Fig.-12
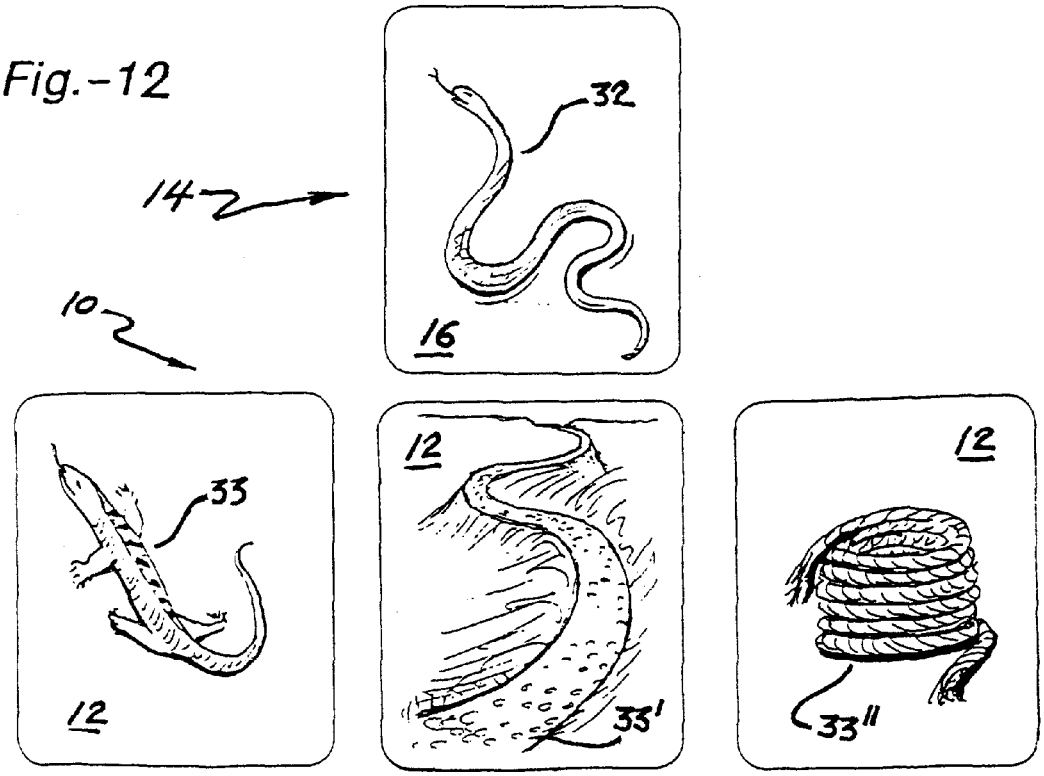

CREATIVE COMPARISON CARD-GAME W/BOARD-GAME VARIANT

BACKGROUND OF THE INVENTION

1. Field of the Invention

This invention relates to wording games involving nouns and adjactives; and more specifically, it relates to multi-player games employing hand-held cards bearing words, possibly in conjunction with a playing-board and a player selecting device.

2. Relevant Prior-Art

Background research discovery provides some prior patent-art regarded as the closest inventions germane to this disclosure, chronologically for example, in U.S. Pat. No. 4,682,777(filed: July 1986) is shown a word-definition game employing a playing-board in combination with playing-cards, each card having a different word on one side (plus a definition of that very word on the opposite-side). Thus, players are in turn required to draw one of the cards of like color to the color of the board-space the player has randomly landed upon, whereupon that player is read a definition for a word beginning with randomly landed upon, whereupon that player is read a definition for a word beginning with the letter represented on that space. If that player guesses the word, they cover the space with a marker-tile and then must correctly spell the word. If spelled correctly, that player is awarded a marker of their assigned color; and upon collecting three such markers they may exchange them for a board-letter covering tile. That player's turn continues until they fail to guess or spell a word correctly; Hence, the player covering the most board-letters wins! There is no optional boardless embodiment of the game contemplated, and playing-board advancing spaces are arranged along the four-sides of the board, including spaces progressionally bearing a letter(counsant) of the alphabet; while the inward board area space is provided for reserve playing-cards.

In U.S. Pat. No. 5,645,280(filed: March 1996) is set forth a rather complex boardgame called "WORDOPOLY"™ for two or more players, involving playing-cards, some of which exhibit a word to be pronounced and defined aloud, a category of question to be answered by players, or may exhibit instruction for further play. Correct pronunciation and definition of the drawn word-card, or correct answer to the selected question, earns players a word-definition card. Hence, players earning entire sets of word-definition cards of particular colors acquire advantage in the game; since the player gaining vocabulary word-definition cards representative of all letter-spaces upon the game-board will win the game. The playing-board advancing spaces are arranged along the four-sides of the board, and include intermitent spaces progressionally bearing a letter from the alphabet; while the inward board area bears spaces for reserve playing-cards. There is no optional boardless embodiment of the game contemplated.

In U.S. Pat. No. 4,055,348(filed: October 1975) shows a icosahedron(20-facet) regular-polyhedron dice chance-divice, each facet(indicia-bearing area) of which bears at least one English alphabet-letter(consonate or vowel). Plus, U.S. Pat. No. 3,642,286(filed: December 1969) shows both cubical(sextahedron) and dodecahedron(12-facet) regular polyhedral dies, the facets of which bear indicia in the form arrows having at least two arrowheads; which are employed to point toward the required direction(s) of play-motion. Hence, none of the die devices are capable of singularly pointing toward the next player, as a way of randomly determining player selection.

Therefore, in full consideration of the preceding patent review, there is determined a need for another form of game-plan to which these patents have been largely addressed. The instant inventor hereof finds the preceding "discriptive wording" games far to involved and complex with details in strategy for popular commercial appeal. Hence, the instant inventor hereof believes their newly conceived card-game, tentatively referred to as "APPLES & ORANGES"™ (although may commercially become known as APPLES to APPLES™), currently being developed for production under auspices of Kirbygame-Mfg./Mkt.Co., exhibits a stimulating, yet far simpler and more merchandizable gameplan; as well as other advantages as shall be revealed in the subsequent portion of this instant disclosure.

II.) SUMMARY OF THE INVENTION

A.) The Basic Game-Plan Embodiment

In view of the foregoing revelation about the earlier invention art, it is therefore important to make it pellucid to others interested in the art that the object of this new invention is to provide a delightfully spontaneous if unpredictable creative and stimulating wording card-game playable by three or more persons, in a novel game-plan involving comparison and matching of things such as word elements representing things (single or plural), concepts, or graphic images. Thus in it's broadest sense, the unique game-plan hereof can be adapted as words devised to ask a question on one set of myriad playing-cards, while the counter-set of playing-cards carry a word/wording as an element devised to answer that question; —hence, competitive play action commences as players are compelled to try for what they perceive as a "best match-up" comparison of graphics such as a word(s) or pictorial indicia appearing upon a player's dealt hand of cards verses the word(s) indicia represented upon another player's counter-set of drawn cards.

Not another game of strategy or word defining, nor spelling, the basis of the present exemplified game, referred to herein as "QUICKPIK™", calls for two sets of myriad cards, one set, will for sake of convenience herein, be referred to as the "apple-cards"(preferably red in color), each inscribed with a noun based term, such as a word(s) naming something, like—"a person (perhaps—ELVIS PRESTLEY), event (perhaps—WOODSTOCK), place (perhaps—YELLOWSTONE NAT.PARK), thing (perhaps—TELEPHONE BOOTH), or something in nature (perhaps—BABY ELEPHANT), etc.". The other set of cards may be conveniently referred to as the "orange-cards" (preferably orange in color), each of which is inscribed with one or more adjective based term, such as a word(s) stating a descriptive characteristic, like—"MAGNIFICENT, HURTFUL, SILLY, STUPID, PUZZLING, DANGEROUS, CREATIVE, etc.".

Accordingly, a further generic variant of this cardgame may be to provide a set of "response phrased" based wording faced cards (substantially equivalent in game-play to previously described apple-cards) to be compared by players relative to a card selected at random from a set of "open-ended statement phrased" based cards (substantially equivalent in game-play to previously described orange-cards). A still further generic-variant iteration may be, to provide a set of "object"-cards each bearing a different "pictographic icon" upon their faces (albeit substantially equivalent in game-play to the previously described apple-cards), as to be compared by players relative to a card selected at random from a set of "comparator"-cards each bearing a different pictograph or the previously stated descriptive word upon its card face (albeit substantially equivalent in game-play to the previously described orange-cards). Hence, with these features in mind, the essential principle of the game is to cause or motivate its players to make comparison of things very likely in a way they would not normally tend to compare; that is, to mindfully choose from a group of not necessarily similar or relevant features; —hence, comparing apples-&-oranges!

For example, of three random apple-cards possibly collectively stating the generally noun based words—"MULE, EDSEL, CANDY", one might happen to randomly select from an assortment of generally adjective based orange-cards the term "UGLY", a player might feel the defunct 1960's "EDSEL"-car was an attractive car (many would not agree) and rather choose aloud "MULE". However, another player might opinion that the concept of "CANDY" is ugly (feeling it makes them fat and ugly), and would thus rather play that card. Therefore, it can be appreciated that even in the simplist iteration of this game as a pure card-game, such random combinations of words, will more often than not, result in provocative and controversial exclamations, creating an atmosphere of often bombastic opinions, which can be highly insightful, if amusingly entertaining.

Note that, nowhere in the game-plan are alphabetic-letters (consonants & vowels) employed individually, nor is an object of the game to encourage correct spelling. The prime intent of the instant game hereof is clearly to incite controversy among its players, creating an atmosphere of social unrest in a rather subtle manner, evoking personal feelings and emotions in a manner never before achieved in a manner of parlor-game.

Rules to Play the Basic Cardgame Quickpik™

Some predetermined number (call it X-number) of pre-shuffled Apple-cards are passed-out to each player, who are to poise their cards in hand so as the indicia word(s) cannot be espied by another player. Then—a.) a player to be JUDGE is chosen to start a round of play, with the full box (or a face-down stack mixed at random) of Orange-cards positioned in front of themself. The Judge lifts an Orange-card from the box placing it face-up on the cardtable in full view of the other players, while announcing the word or term appearing upon that card; b.) next, every player except the Judge scans their Apple-cards to determine in their mind the card which best-matches (most suitably in their opinion) the turned-up Orange-card; whereupon, the players toss-in that card face-down with (back-side up), while the Judge determines which player was the last to throw-in an Apple-card. c.) next, the Judge mixes-up all the thrown-in Apple-cards so as to be unable to know what card came from which player; —at which point Judge turns-over each of the Apple-cards so all players may see them; d.) next, the Judge determines in their own opinion which Apple-card best-matches the turned-up Orange-card (note: while the reason for the Judge's selection of a particular Apple-card is not important to the game-plan, it is nevertheless fun for the players to make possibly snide conjecture about it!!); e.) next, the player having tossed-in the selected Apple-card WINS that Orange-card, and places it in front of themself; f.) next, the player determined by the Judge as having been last in throwing-in (placing-in or entering) an Apple-card, and who happened to be the Winner of that play-segment, forfeits collecting of that Orange-card (yet has still prevented some other player from winning it); g.) next, after that play-segment round is done, each player (excepting the Judge) then replace their thrown-in Apple-card with a new one from the top of the Apple-card deck, while the used Apple-cards may be reintroduced at the bottom of the Apple-card deck; h.) the player to be Judge then rotates to the next person (preferably to their left) after every round, and game-play continues in repetition as before; the first player to accumulate some predetermined quantity, say ten(10, or X-number as may be determined by the rules) Orange-cards therefore wins the overall game. In this most basic exemplified iteration, there is no game playing-board nor selection-die required.

Rules of the Optional Lame-Cards

If the Judge thinks a thrown-in Apple-card is especially non-applicable (not very playable), the Judge can call aloud "LAME". Then if the majority of players in the game round agree, the player having entered the "Lame"-card gets the card replaced into their Orange-card stack, as one(1)-demerit against won Orange-cards. If the majority of players do not agree, then the Judge keeps the demerit Apple-card.

Rule of the Optional Wager-Cards

In addition to the regular Apple-cards that are passed-out at beginning of the game, all players are dealt another card preferably reading "WAGER" upon both its face and back-side. Thus, after an Orange-card is turned face-up and players throw-in (enter) their Apple-card, players can elect to also toss-in(enter) their Wager-card as well. The total number of Wager-cards then dictates how many Orange-cards will be in the "reward" for being the Apple-card selected; hence, throwing-in a Wager-card indicates that player who entered the Wager-card believes they have a "good-match" (and may win the hand)! If only one Wager-card is entered, then the game defaults to the original game where players are playing for one Orange-card for that round. However, if two, three, four, or more Wager-cards are played, then that means all of those players think that they each have the best match; and, that they will win the round. Therefore, the stakes become raised somewhat like in Poker, because now the winner of the round wins as many Orange-cards as the played Wager-cards! So tossing-in a Wager-card is risky, but enables one to win more Orange-cards (especially if one needs to catch-up), yet it only matters if someone else also thinks they have the best match for the round. —Hence, rounds where more than one player feels they have a good-match become much more interesting! Wager-cards are preferably returned to their players after each round.

The separate card sets of paragraphs-A/B will probably be sold separately as a beginners set-A, only containing Apples (noun words) and Orange(adjective words) cards; and, as a separate set-B containing only MindReader cards, enabling purchasers to expand into the paragraph-B version. Plus, it is planned to provide a combined delux set-A&B set of cards, for those intending to mainly play the MindReader version of my game invention.

B.) A Variant Cardgame Embodiment

Another object of this invention disclosure is to set forth an APPLES & ORANGES™ generic-variant game-plan, wherein rules supplemental to preceding paragraph-A provide for a card-game version herein referred to as the "MINDREADER™". In this expanded rules version, it is required that special playing-cards, preferably bearing the tradename MINDREADER™ upon their face (frontside, their backsides to appear identical to the Orange-cards), be shuffled-in as many as desired with the regular Orange-cards from the preceding item-A QUICKPIK™ version.

The game-plan remains essentially the same, except—, a.) when the provisional "ROLLER" (the "Judge" in previous paragraph-A) suddenly turns-over an Orange-card having "MindReader" imprinted upon its face, whereupon the Roller turns over Orange-cards until a regular one with an adjective term turns-up; then, b.) that Roller throws(rolls) a chance-selector ArrowDie™ (a single commercially available dice preferably having six to twelve regular facets, each facet bearing an arrow thereon), the apex-facet (stopped horizontal to the rolling surface) arrow pointing nearest a player determines who becomes "PICKER"; c.) then, the Roller rolls the die again and the next player pointed at by the arrow becomes "MINDREADER"; d.) then, the Roller chooses three Apple-cards from their hand so that it is difficult for the Picker to decide which Apple-cards best matches the the turned-up Orange-card, and the Roller places these three Apple-cards in front of the Picker face-up for all to see; e.) then, the Picker decides which Apple-card best matches the Orange-card, and waits until the MindReader jots-down (writes on a pad or tablet) their guess before announcing it to other players; f.) then, the MindReader guesses which Apple-card they think the Picker will choose, and jots it down; g.) then, the Picker says aloud what their choice is, and compares it to the MindReader's noted guess; h.) if the Picker and MindReader happen to select the same word, they BOTH WIN so both collect one (or X-number as rules may dictate) Orange-card, while the Roller gets nothing; however, if the Picker and MindReader do not choose the same word, the Roller has "stumped" them, and thus collects three (or X-number as rules may dictate) Orange-cards, in which case the Picker and MindReader get nothing; i.) then, collected Orange-cards are placed in front of the players (Roller, MindReader, Picker) as in the QUICKPIK™-version, and the Roller replaces their played Apple-cards with new ones, whereupon game-play repeats with the next player to the left (preferably) becoming subsequent Judge (and Roller).

C.) The Gameboard Embodiment

Another object of this invention disclosure is to set forth a more elaborate generic-variant game-plan referred to as "JUMBO-A&O"™, involving still further supplemental-rules and apparatus over that provided in the two preceding card-game versions, but performed in conjunction with a playing-board. So as to be a natural progression to those already initiated into the game-plan of the versions set forth in preceding paragraphs-A&B, this iteration substantially embodies those rules as set forth in preceding paragraph-B, plus the addition of several features primarily associated with the function of the playing-board (gameboard).

Accordingly, the thrust of the game is to be the first player to make it to the Winner'sCircle and "stump" the opposition on that turn. The players begin: a.) by choosing a playing-piece (a three-dimensional reference icon) and placing it upon the "Start"-pad graphically shown upon the gameboard; b.) then, a predetermined number (preagreed to X-number as may be determined by the rules) of say seven randomly shuffled Apple-cards are dealt out (preferably with a convenient card-holder) to each player, who each orient their own cards in a concealed manner such that players can observe only their own key noun based words; c.) then, either roll for the highest number on a conventional throwing-die, or employ an ArrowDie™, to determine who goes first; that player then rolls the die again and advances their playing-piece that many function-squares toward the Winner'sCircle (or goal-square); d.) then, at the end of each round of players, return used Apple-cards and Orange-cards back in their respective card-boxes(or stack), while anyone having played their Apple-cards replaces them with new ones (for example if it was decided each player is to have seven Apple-cards at all times); e.) then, when landing upon one of the preferably plain blue-colored "Basic-squares" provided upon the gameboard, proceed substantially according to the course of action outlined in previous paragraph-B (MindReader-instructions, except that in my boardgame iteration the MindReader-CARDS are supplanted (substituted) by fundamentally equivalent functions-squares preferably referred to as Basic-squares (mindReader-SQUARES if you will); f.) thus, the Judge (momentarily acting as the Roller) throws the ArrowDie™ (or any chanch-selector device, such as perhaps twisting a spinner) observing the pointer(arrow) to see who the Picker is to be during the first round, and likewise to find out who the MindReader player is to be during the same round segment, whereupon the Judge(Roller) selects the Apple-cards (as in paragraph-B; g.) now, the Picker decides which Apple-card best matches the word appearing upon the Orange-card, and waits until the MindReader jots it down on a memo-pad (or conventional commercially available eraseable-slate), at which point the Picker announces what their choice is and compares it with the MindReader's guess written upon the tablet; h.) then, if Picker and MindReader have selected the same word, they win and each advance two (or X-number, according to the rules) function-squares of the board, but the Judge(Roller) does not advance; however, if Picker and Mindreader players did not choose the same word, the Judge(Roller) has "stumped" them and Judge thus moves forward four (or X-number as rules may dictate) function-squares (in which case Picker and MindReader do not get to advance).

D.) Preferred Squares of Gameboard's Pathway Layout

The BASIC-SQUARE: —already mentioned in paragraph-C, the preferably unmarked "Basic-square" is employed in the following exemplified manner . . . Let's say it is now Jim's turn to be Judge(and Roller) so momentarily takes possession of the box(or stack) of Orange-cards from the prior Judge(Roller). Thus Jim rolls a conventional cube-die, and as result counts six function-square spaces, landing upon a so-called "Basic-square"; and then, employing a conventional chance-selector device such as an arrow-spinner or rolling an ArrowDie (an arrow on each facet), which stops with its apex-facet arrow pointing toward Alice, so she becomes provisional Picker of the round; he then rolls it again and it points to Hank, thus Hank becomes the MindReader for the round.

The RANDOM-SQUARE: —is a plurality of function-square landing spaces identified via indicia preferably such as an "R" displayed thereon, to be played much like a Basic-square except that the Judge(provisional Roller) does not get to choose their own Apple-cards, instead the Judge(die Roller) must choose them at random from the top of the Apple-card stack (supply-deck).

The WAGER-SQUARE: —is a plurality of function-square landing spaces identified via indicia preferably such as a "W" displayed thereon, and are played much like a Basic-square except that before the Judge(Roller) presents their three selected Apple-cards, the Judge must wager at least one and up to seven (or X-number as the rules may dictate) function-squares. These cards represent the number of squares that the Judge will move forward, if having "stumped" the opposition: —or conversely, the number of function-squares the Judge is required to retreat if the opposition is not stumped.

The QUICKPIK-SQUARE: —is played according to rules established in paragraph-A, except that the player the providional(for that round of play) Judge opinions has the best match-up for the up-turned Orange-card, then moves forward X-number (some predetermined quantity) of squares, the Judge also moving forward a lesser number of squares.

III.) DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the claims section annexed hereto; and accordingly, a better understanding of the invention and the variant uses is intended, by reference to the drawings, which are considered as primarily exemplary and not to be therefore construed as restrictive in nature; wherein:

FIG. 1, shows a direct face-up view of some overlapping so-called Apple-cards, whereupon is depicted noun word based graphic indicia; including a single specimen Apple-card arranged at the far-left thereof revealing a preferred in-common graphic Apple-design theme for their back-sides;

FIG. 2, shows a half-scale direct face-up view of a single selected Orange-card from FIG. 3, and three chosen Apple-cards from FIG. 1, for exemplified comparison;

FIG. 3, shows a direct face-up view of some overlapping so-called Orange-cards, whereon is depicted adjective-word based graphic indicia, including a single specimen Orange-card arranged at the far-left thereof revealing a preferred in-common graphic Orange-design theme for their back-sides;

FIG. 4, shows a reference-chart exemplifying some of the possible combinations of object-type (Apple) cards versus comparator-type (Orange) cards;

FIG. 5, shows a direct face-up view of a so-called Mindreader-card specimen, whereon is depicted possible associated graphic indicia, including an Orange-card back-side;

FIG. 8, shows some exemplified icon like player-position marker-pieces;

FIG. 9, shows a commercially available dodecahedron chance-selector bearing an arrow indicia upon each of its twelve facets, for optional player-selection usage;

FIG. 10, shows a commercially available sextahedron chance-selector device, bearing dot-indicia upon each of its six facets, for optional player-moves usage;

FIG. 11, shows a commercially available arrow-spinner device, for optional player-selection usage;

FIG. 12, shows a half-scale direct face-up view of a single Orange type card and three Apple type cards each bearing pictographed icons for exemplified comparison, demonstrating how wordless pictographed playing-cards may likewise be adapted to the game's unique basic player-subjective "comparison" play-action;

IV.) ITEMIZED NOMENCLATURE REFERENCES

Figure 6:
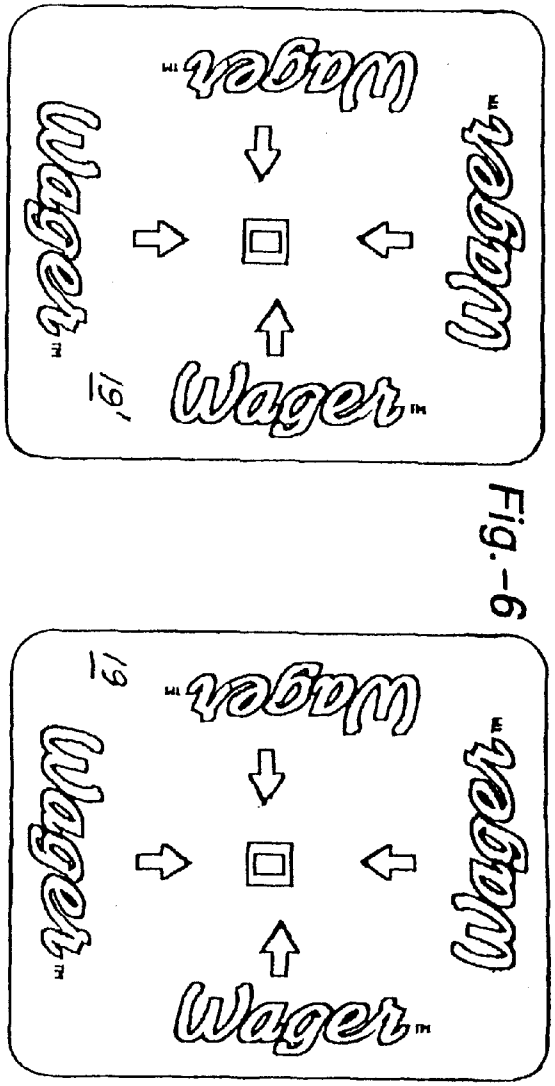
FIG. 6, shows a direct face-up view of a so-called Wager-card specimen, whereon is depicted possible associated graphic indicia, including it's exemplified identical back-side graphics arranged to the left thereof.

10—Apple-card
11—back-side of Apple-cards
12—face-up side of Apple-cards
13/13'—object wording (noun words/response words)
14—Orange-cards
15—back-side Orange-cards
16—face-up side of Orange-cards
17/17'—comparator wording (adjective word(s)/open-ended statement words)
18/18'—MindReader-cards (face-side/back-side)
19/19'—Wager-cards (face-side/back-side)
20—gameboard
21—starting-pad
22—goal-square
23—Basic-squares
24—Random-squares
25—Wager-squares
26—QuickPik-squares
27—Trade-in squares
28/28'/28"—player-piece examples (dolphin/eagle/lion)
29—segmented pathway
30/30'/30"—chance-selectors (dodecahedron/sextahedron/spinner)
31—pointer-arrows
32—pictograph upon face-side of Orange-card
33/33'/33"—different pictograph objects upon face of Apple-cards

V.) DETAILED DESCRIPTION OF THE PREFERRED EMBODIMENTS

Initial reference is given by way of FIG. 1, wherein is exhibited the back-side 11 of a single so-called Apple-card 10 at left, and at right are an overlapping group of six more Apple-cards 10 showing their face-side 12 facing-up. The face-side graphics can be anything really, however since I prefer to call the game "Apples&Oranges™", then graphic-art representation of an apple here seems most appropriate. Hence. some noun words or wording 13 shown individually exemplified thereon, as—"YOUR HAIR, HUMMING BIRDS, ELVIS PRESTLEY, THE GRAND CANYON, A HIGHSCHOOL FOOTBALL GAME, RUST"—can likewise be an almost endless variety of such words (identifying people, places, events. nature, and things), with myriad fresh card wordings to be introduced by publishing new sets periodically as the marketplace dictates (for example, besides well known historic word usages, words reflecting topics currently in the news). Accordingly, these Apple-cards are to be treated in the manner previously described in the afore going summary-section, thus are to be played against the cards of FIG. 3.

The comparator cards of FIG. 3 include the back-side 15 of a single so-called Orange-card 14 at left, while included at right is an overlapping group of five more Orange-cards showing their face-side 16 facing-up. Again, the face-side graphics can be anything really, but again, since I prefer calling the game "Apples&Oranges™" then the graphic-art representation of an orange here seems appropriate here. Hence, the exemplified adjective words 17 shown individually exemplified thereon are—"MAGNIFICENT, SILLY HURTFUL, DANGEROUS, PUZZLING" (yet, there are numerous other such discriptive words which may be similarly utilized). Orange-cards are to be treated in the manner previously described in the afore going summary-section.

The four cards of FIG. 2 serve to depict how the worded cards of FIGS. 1 & 3 are employed in the manner of Apple&Oranges via the Apple-card wording (upon face-side 12) relative to the Orange-card's comparator wording (appearing upon face-side 16). Here, the three exemplified noun-word choices: A.) YOUR HAIR, B.) ELVIS PRESTLY, C.) THE GRAND CANYON, are compared to the adjective-word "MAGNIFICENT" 17. A player(Judge) wil have to decide which is more magnificent: "your hair, Elvis Prestley, or the Grand Canyon". This preposterous situation posed of having to determine the best (in one's personal opinion) match-up of responses, —serves to stimulate jocular riposte amongst players.

Reference to FIG. 4 serves as a quick guide, by noting the combinations given in the roman-numerals I.–V. the observer can readily see, even in this limited example, just how varied the basic notion of comparing Apples&Oranges can really become.

In FIG. 5 is shown a so-called MindReader™-card, which optionally may be randomly interspersed among the Orange-cards, the MindReader's back-side bearing the Orange-card identifying graphics.

Reference to FIG. 6 exhibits a so-called Wager-card, which optionally may be dealt to players, the Wager-card's distinguishing face-side 19 preferably being graphically replicated upon its back-side 19', —thereby assuring its being readily identifiable as a card to be treated in the manner prescribed in the afore going summary-section.

Figure 7:
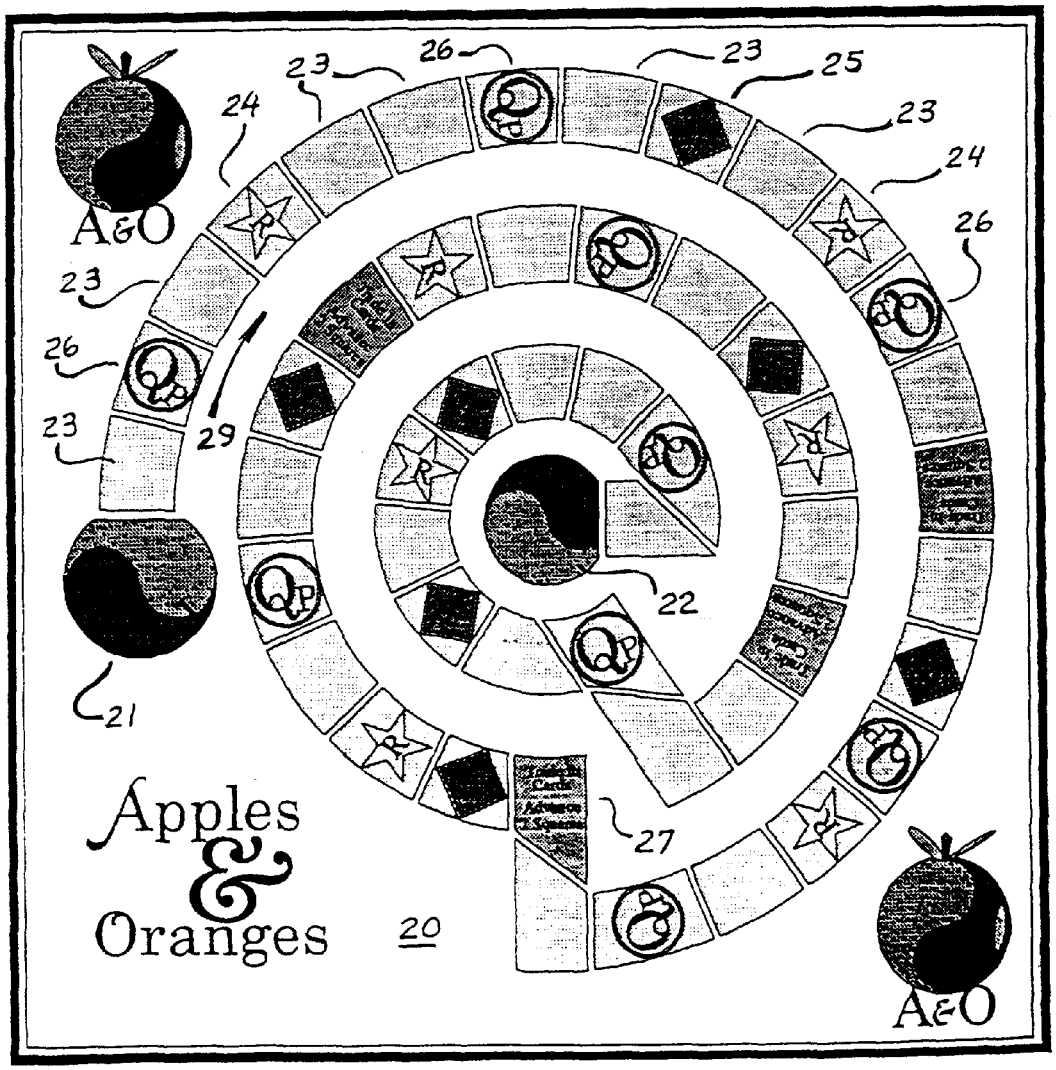
FIG. 7, shows the overall playing-board and exemplified preferred semi-spiral like arrangement of the squared-segment pathway leading to the central winners-circle.

Study of FIG. 7 shows the preferred layout for an optional gameboard 20 having a starting-pad 21 where all the players respective player-pieces (see FIG. 8) are initially assembled. Then following the prescribed manner of play action given in afore going summary-section-D, the players in turn make their individual progressions of movement toward the winner's-circle goal-square 22; —the first player to land in the goal-square being the winner! Along the way toward the winner's-circle the players will encounter the more pervasive Basic-squares 23, the Random-squares 24, the Wager-squares 25, the QuickPik-square 26, and Trade-in squares 27.

The three different icons of FIG. 8 serve only to exemplify the different player-pieces 28 (here a symbolic dolphin shape), 28'(here a symbolic eagle shape), and 28"(here a symbolic lion shape). Since these shapes have no particular meaning to the nature of the boardgame, virtually any symbolic shape will suffice, serving only to demark that respective player's play-position upon the segmented board-path 29 in FIG. 7.

Looking at FIGS. 9,10,11, suggests the different chance-selector devices, 30 being a regular dodecahedron bearing random pointer-arrows 31, one upon each facet plane thereof, device 30' being a regular cubic sextahedron bearing a conventional random dot-matrix 30' (one upon each facet plane thereof), device 30" being a conventional 2-piece manually spun arrow-spinner 31 device. The function of the arrowed polyhedral-shape 30 (subject of pending U.S. patent application Ser. No. 08/939,071 by inventor hereof) is to simply point to a thus selected player once the die rolls to a thrown random stop position. The function of the cubic-die sextahedron 30' being to determine the number of board-pathway 29 squares to advance, while spinner 31 is here adapted to point to a thus selected player once the pointer spins to a random stop position; again, in keeping with game play-action procedures outlined in the preceding summary-section.

There remain subtle, however vital other differences which are to become herein more evident and understood as inherent to the basic premise of this game invention, that regardless as to the exemplified embodiment, the intrinsic notion of the game is to always be comparing one concept to another in some manner.

By way of a further example, FIG. 12 reveals how a juvenile version hereof, may employ playing-cards bearing only pictorial images instead of wording, whereby an Orange-card 14 bearing upon its face a reptile such as a SNAKE illustration 32 upon it's face-side 16, which may be matched against preferably three exemplified random Apple-cards having other object indicia illustrated thereon their face-side 12 such as possibly a LIZARD 33, a pathway 33', and a ROPE 33". The player(Judge) will have to decide which is more like a snake: —a lizard, a winding pathway, a coil of rope. Thus, while the Judge player may select the illustrated ROPE 33" because it appears coiled like the SNAKE 32, an opposing player may choose the illustrated pathway 33', to them, because of the way it "snakes" across the terrain;—hence, a game-plan which in the abstract is always tantamount to comparing apples-&-oranges!

Figure 13:
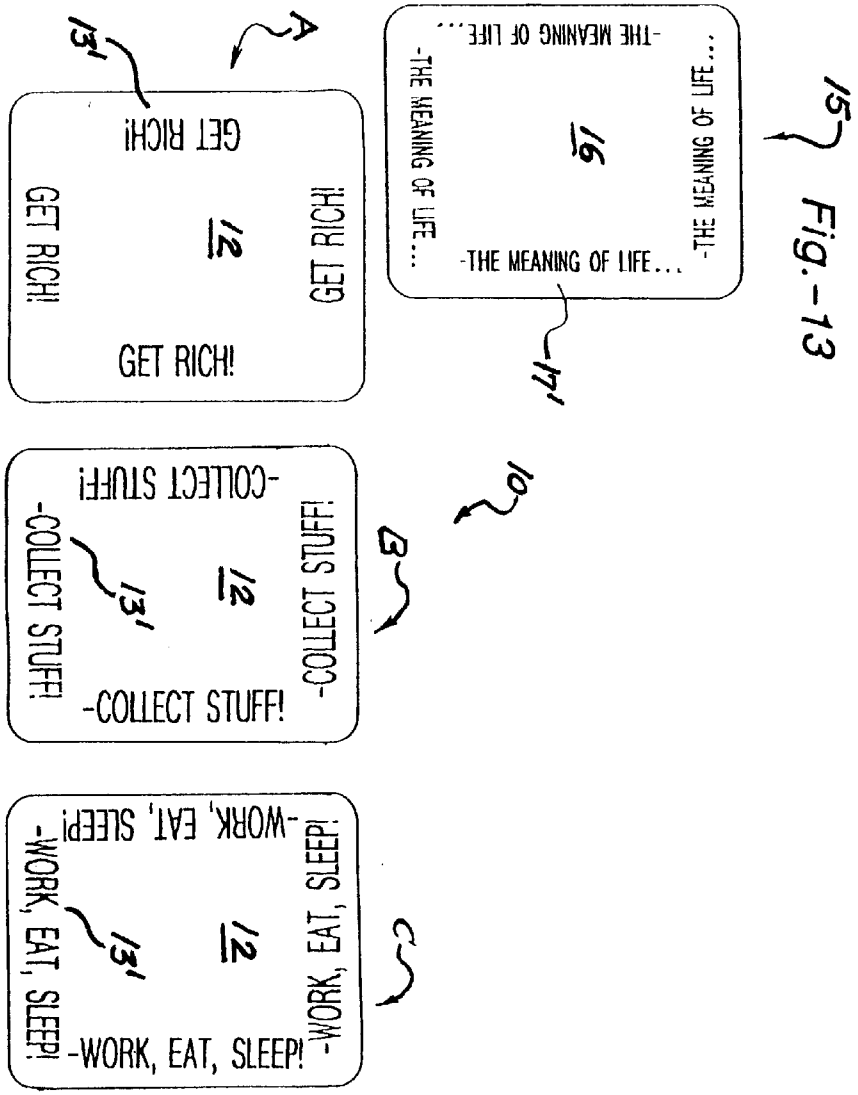
FIG. 13, shows another half-scale direct face-up view of a single Orange type card and three Apple type cards, here bearing exemplified phrasing for creative match-up of a possible answer to a random question.

Finally, the four cards of FIG. 13 depict how my worded cards can also be employed in the manner of the three response phrase-based cards 12 in relationship to the open-ended statement phrased-based card 16. Here, the prodigious question is posed: what is-"THE MEANING OF LIFE?", —must be decided. The absurd situation of having to decide such an enigmatic question predicated upon the answers: A.) GET RICH!, B.) COLLECT STUFF!, C.) WORK, EAT, SLEEP!, —is what makes for humorous repartee among the players.

Again, the card back-sides (not shown in FIGS. 2, 12, 13, but see FIGS. 1&3) can employ any manner of graphics besides the preferred apple/orange simile or metaphor. Moreover, the game is not to be construed as any particular "coherent" form of direct question and specific answer, such as methodology of the well known "Trivial-Persuit®"—game (or conversely, answers-and-questions) per'se; although certainly question-cards versus answer-cards can be employed in the game-plan hereof, to the extent that players could be required to make a best-effort match-up in their individual opinion, which would ultimately be compared to the Judge's choice. Accordingly, it is the intention of the inventor hereof that a constant infusion of new playing-cards be marketed over the years, which would be based upon the novel proprietary notion of the intrinsic game-plan being exemplified herein.

Finally, by way of still further clarifying the flexibility of playing my cardgame, the procedural flow-chart of FIG. 14 universally explains the basic notion of employing player Object based cards in relation to a so-called Judge's chosen Comparator based card. Hence, weather my cards bare an imprinted word (or words), pictorgraph, or other element, the general notion of my game-plan procedure being to pursue subjective "best match-up" comparison of several possible things (identified upon one's hand of cards) to one thing (identified upon a Judge's or equivalent appointed person's chosen card); thus, one does not engage in sentence-syntax structuring in any way (such as for example, is taught in the educational cardgame of U.S. Pat. No. 3,618,231).

Thus, it is readily understood how the preferred and generic-variant embodiments of this invention contemplate performing functions in a novel way not heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended claims set out the scope of the invention sought, and are to be construed as broadly as the terminology therein employed permits, reckoning that the invention verily comprehends every use of which it is susceptible. Accordingly, the embodiments of the invention in which an exclusive property or proprietary privilege is claimed, are defined as follows.

What is claimed of proprietary inventive origin is:

1. A method of playing a word based entertainment cardgame providing for competitive play-action between a plurality of players by which to creatively match most appropriate word terms, said method comprising:

a) providing a first set of cards object cards inscribed with a noun based term, pictographic icon or a phrase in the form of an answer, b) providing a second set of comparator cards inscribed with a descriptive word, adjective, pictographic icon or a phrase in the form of a question, c) passing a plurality of said first cards to each player, d) choosing a player to be the judge, e) selecting a second card from said set and placing it face up, f) each player except the judge determining from said plurality of said first cards to each player a card which in their opinion best matches said selected second card and placing that card face down, g) the judge then determining in their own opinion which first card best matches said second card, h) said player placing said first card determined by the judge as best matches wins said selected second card.

2. The method according to claim 1, further comprising the step of the judge mixing up the face down first cards prior to the step of the judge determining.

3. The method according to claim 1, further comprising in step (f) above the step of the judge determining which player was the last to place a first card whereby a player that wins said selected second card and who is determined to be the player which was the last to place a first card forfeits collecting that second card.

4. The method according to claim 2, further comprising the step of the judge determining which player was the last to place a first card whereby a player that wins said selected second card and who is determined to be the player which was the last to place a first card forfeits collecting that second card.

5. The method according to claim 1, further comprising the step repeating each said step a plurality of times until a player has accumulated a predetermined quantity of second cards.

6. The method according to claim 2, further comprising the step repeating each said step a plurality of times until a player has accumulated a predetermined quantity of second cards.

7. The method according to claim 4, further comprising the step repeating each said step a plurality of times until a player has accumulated a predetermined quantity of second cards.

8. The method according to claim 1, further comprising the step repeating allowing a judge to declare that a selected and placed first card is lame whereby the player having placed said card gets one demerit against any won second cards.

9. The method according to claim 1, further comprising the step of providing a wager card to each player whereby a player may place said wager card during said step of placing a first card face down and the player that wins said selected second card wins as many second cards as wager card that have been placed.

10. The method according to claim 1, further comprising the step of providing individual player pieces, a chance selector device and a game board whereby the players move said player pieces towards a winner's circle goal in order to be declared a winner.

* * * * *